United States Patent [19]

Ikeda

[11] 4,300,308

[45] Nov. 17, 1981

[54] TOY VEHICLE CAPABLE OF TRAVELING ON BOTH ITS TOP AND BOTTOM SURFACES

[75] Inventor: Masaki Ikeda, Tokyo, Japan

[73] Assignee: Tomy Kogyo Co., Inc., Tokyo, Japan

[21] Appl. No.: 143,092

[22] Filed: Apr. 23, 1980

[30] Foreign Application Priority Data

Jun. 15, 1979 [JP] Japan ..... 54-82416[U]

[51] Int. Cl.[3] ..... A63H 17/00; A63H 17/40; A63H 11/10

[52] U.S. Cl. ..... 46/206; 46/201; 46/212

[58] Field of Search ..... 46/206, 212, 201, 202, 46/251, 111, 112, 97, 98-105, 204, 211

[56] References Cited

U.S. PATENT DOCUMENTS

| | | | |
|---|---|---|---|
| 1,586,608 | 6/1926 | Carver | 46/201 |
| 1,846,823 | 2/1932 | Westberg | 46/202 |
| 1,875,109 | 8/1932 | Muller | 46/211 |
| 2,001,625 | 5/1935 | Muller | 46/211 |
| 2,247,354 | 7/1941 | Berger | 46/212 |
| 3,000,137 | 9/1961 | Vine | 46/211 |
| 3,574,267 | 4/1971 | Schorsch | 46/211 |
| 3,650,067 | 3/1972 | Greenwood | 46/206 |
| 3,728,815 | 4/1973 | Tomiyama | 46/104 |
| 3,816,958 | 6/1974 | Winston | 46/202 |

*Primary Examiner*—Gene Mancene
*Assistant Examiner*—Michael J. Foycik, Jr.
*Attorney, Agent, or Firm*—K. H. Boswell; Edward D. O'Brian

[57] ABSTRACT

A toy vehicle has a first and a second surface which are spaced apart from one another and reversibly serve as the top and bottom of a vehicle. When one of the surfaces is serving as the top of the vehicle the opposite surface of the vehicle is serving as the bottom of the vehicle. The vehicle includes wheel members which are capable of supporting the vehicle over a support surface no matter which of the surfaces of the vehicle is serving as the top or the bottom. Also incorporated in the vehicle is an inverting mechanism which alternately inverts the vehicle such that the surface serving as the top of the vehicle after inverting serves as the bottom of the vehicle and the surface serving as the bottom of the vehicle after inverting serves as the top of the vehicle.

7 Claims, 5 Drawing Figures

10
14
22
24
26
28
32
34
30
20
36
38
40
42
44
46
48
50
52
54
64
66
72
76
78
80
82
4
4

10
12
14
16
18
20
22
24
26
28
32
36
44
48
50
52
54
56
58
60
62
64
66
68
70
72
74
76
78
80
100
102
104

TOY VEHICLE CAPABLE OF TRAVELING ON BOTH ITS TOP AND BOTTOM SURFACES

BACKGROUND OF THE INVENTION

A toy vehicle is described which has two surfaces spaced apart from one another and each of the surfaces is reversibly capable of serving as the top and bottom of the vehicle. Included with the vehicle are wheel members supporting the vehicle no matter how it is oriented and an inversion mechanism which flips the vehicle over reversing the top and the bottom in a cyclic manner.

Toys are known which have the capability of righting themselves either when they are turned over by the user of the toy or are tipped by a mechanism within the toy. Such toys include the toy truck of U.S. Pat. No. 1,846,823 which tips itself over and then rights itself, the robot of U.S. Pat. No. 3,728,815 which rolls over and then rights itself and the toy mouse of U.S. Pat. No. 1,875,109 which if dropped will roll over onto its wheels and then move across a surface. p Certain toy vehicles are known such as those described in U.S. Pat. Nos. 3,000,137 and 3,574,267 which include a fifth wheel or projection beneath the vehicle which is capable of lifting a portion of the vehicle and thus tilting the vehicle with respect to the surface on which it rests.

Another class of toy vehicles include those having extra wheels or gyroscopes which allow them to either move over an erratic path or spin and rotate about some point of the vehicle. Representative examples of this type of toy are found in U.S. Pat. Nos. 2,001,625, 3,816,958 and 3,650,067.

None of the above noted toys or patents describe toy vehicles which are reversible with respect to their top and bottom and thus, in effect, have really no top or bottom. Further, none of the above patents or toys are directed to vehicles which are capable of propelling themselves on a set of wheels, inverting themselves and then continuing to propel themselves utilizing the same set of wheels. It is submitted that such a toy would be exceedingly interesting to a child.

BRIEF SUMMARY OF THE INVENTION

In view of the above it is an object of this invention to provide a toy that, in essence, has no top or bottom but, in fact, has two surfaces which can serve as either top or bottom. It is a further object of this invention to provide a wheeled toy having a set of wheels that are capable of supporting the toy irrespective of the orientation of the above noted surfaces. It is further an object to provide a toy which includes a mechanism capable of inverting the toy in a cyclic manner, and finally, it is an object to provide a toy which is of simple construction and thus easily manufactured and economically available to the consumer.

These and other objects as will become evident from the remainder of this specification are achieved by providing a toy vehicle which comprises: a housing; said housing including a first surface and a second surface spaced apart from each other and both said first surface and said second surface reversibly capable of serving as a top for said housing or a bottom for said housing such that when said first surface serves as said top said second surface serves as said bottom and when said second surface serves as said top said first surface serves as said bottom; moving means mounted on said housing and capable of movably supporting said housing above a support surface such that said housing is capable of moving across said support surface both in a first position when said first surface is said top and said second surface is said bottom and a second position wherein said second surface is said top and said first surface is said bottom; inverting means capable of alternately inverting said housing between said first position and said second position; motor means located in said housing and operatively connected to said inverting means to invert said housing between said first position and said second position.

The moving means of the toy generally will comprises rolling means which allows the vehicle body to roll across the supporting surface. The rolling means preferably comprises wheel means consisting of a plurality of wheels.

The wheels of the toy preferably are of a diameter greater than the distance said first and said second surfaces are spaced apart from each other. This allows the wheels to support the toy no matter which of the first or second surfaces is serving as the top or the bottom.

The inverting means generally comprises a first and a second projection means which are movable between a retracted position and an extended position. When the projection means move from the retracted position to the extended position they contact the supporting surface and invert the toy. Preferably the projection means comprises a first and second lever means which are capable of extending outside of openings in the respective first and second surfaces.

BRIEF DESCRIPTION OF THE DRAWINGS

This invention will be better understood when taken in conjunction with the drawings wherein.

Figure 1:
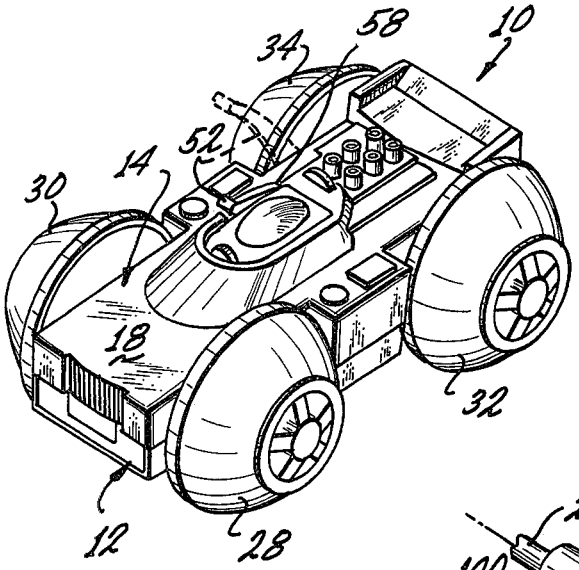
FIG. 1 is an isometric view of the toy of the invention.

The invention illustrated in the drawings and described in this specification utilizes certain principles and concepts as set forth and defined in the claims appended to this specification. Those skilled in the arts to which this invention applies will realize that these principles and concepts could be utilized with a number of differently appearing embodiments without departing from the spirit or scope of the claims. It is for this reason that this invention is to be construed in light of the claims appended hereto and is not to be construed as being limited to the exact embodiment herein described and illustrated.

DETAILED DESCRIPTION

The toy vehicle 10 of the invention has two housing components 12 and 14. Both of the housing components 12 and 14 can reversibly serve as a top or bottom of the toy 10. A different vehicle type motif is molded into each of the housing components 12 and 14 such that depending upon which of the housing components 12 or 14 is upwardly oriented the toy 10 will appear slightly different.

The housing component 12 has a first surface 16 wherein one motif is generally molded. The housing component 14 has a second surface 18 wherein the second motif is molded. The end walls 20 and 22 of the toy 10 are formed from portions of both component 12 and 14 and are molded with motifs which include portions of the motifs incorporated in both the first and second surfaces 16 and 18. For ease of construction the housing components 12 and 14 include a slot and key-like construction (not separately numbered) which allows the housing components 12 and 14 to easily but solidly be joined together by suitable solvent welding techniques and the like.

Figure 4:
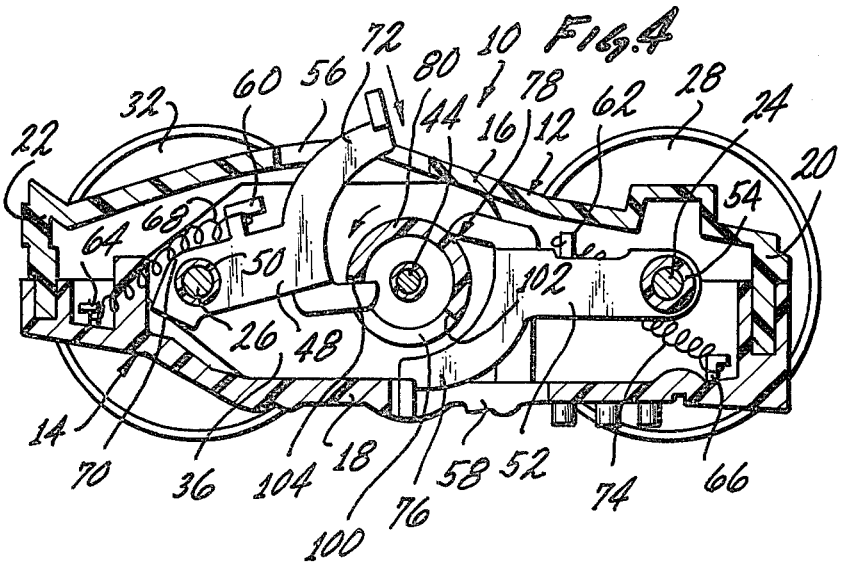
FIG. 4 is a side elevational view in partial section about the line 4—4 of FIG. 3.

A first and second axle 24 and 26 are appropriately journaled in bearing surfaces (not numbered) in the side portions of the housing components 12 and 14. The toy vehicle 10 includes four identical wheels 28, 30, 32 and 34. These wheels have a semispherical shape, the function of which will be described hereinafter, and as seen in FIG. 4 have a diameter which is slightly greater than the distance between the furthermost points located on first and second surfaces 16 and 18. As such no matter which of the first or the second surfaces 16 or 18 is oriented downwardly the wheels 28, 30, 32 and 34 are capable of supporting the toy vehicle 10 above a support surface without having any portions of the housing components 12 or 14 in contact with the support surface. Wheels 28 and 30 form one set of wheels near end 20 and wheels 32 and 34 form a second set of wheels near end 22.

The toy vehicle 10 has neither top nor bottom nor front nor back in the classic sense, but depending on which of the first or second surfaces 16 or 18 are upwardly directed that surface will serve as the top and the other of these surfaces will serve as the bottom and again depending upon which of the surfaces 16 or 18 are upwardly directed the vehicle will travel in one direction or the other so that at one time end 20 will serve as the front of the vehicle and at another time end 22 will serve as the front of the vehicle.

Wheels 28 and 30 are freewheeling about axle 24. Wheels 32 and 34, however, are fixedly attached to axle 26. Axle 26 passes through an internal housing 36 which contains a small spring motor which for the sake of brevity of this specification will not be described or numbered. This motor could be any one of a number of designs for spring motors as is common in the toy art and would contain appropriate springs, gears, speed governors and the like. The axle 26 does not physically connect to the motor, but simply is journaled within housing 36. Fixedly attached to axle 26 is a spur gear 38. A pinion 40 connected via axle 42 to the motor meshes with spur gear 38 and turns spur gear 38 in response to appropriate rotation of the axle 42 by the motor. The driving force of the motor is thus transmitted via axle 26 to wheels 32 and 34 which propels the toy vehicle 10 across the support surface. The axle 26 and the wheels 32 and 34 always rotate in the same direction. Because of this, depending on which of the surfaces 16 or 18 are upwardly oriented the toy vehicle 10 will travel either in the direction of first end wall 20 or in the direction of second end wall 22.

A shaft 44 extends out of the motor housing 36 and through the side walls where the housing components 12 and 14 meet. A knurled knob 46 is fixedly located on the end of shaft 44. Shaft 44 forms a part of the motor and rotation of the knurled knob 46 in a clockwise direction winds the motor and after winding, the shaft 44 and the knurled knob 46 rotate in the opposite direction as the motor unwinds.

A first furcated lever 48 includes a bearing 50 on its end which is freely rotated about axle 26. Because the first lever 48 is freely located on axle 26 rotation of the axle 46 is not transmitted to the lever 48 nor is movement of the lever 48 transferred to the axle 26. A second furcated lever 52 includes an elongated bearing 54 which is freely mounted on axle 24. The second lever 52 is independent of the axle 24 in the same manner as the first lever 48 is independent of the axle 26. Aside from their bearing surfaces 50 and 54, first and second furcated levers 48 and 52 have similar but not identical shapes.

First surface 16 includes an opening 56 and second surface 18 includes an opening 58 through which a portion of first and second furcated lever 48 and 52 can protrude. Both first and second levers 48 and 52 include hooks 60 and 62 respectively. Housing component 16 includes two hooks 64 and 66. A spring 68 extends between hooks 60 and 64. The spring 68 extending between hooks 60 and 64 goes over hump 70 on lever 48 on the side of axle 26 closest to end 22. This biases first furcated lever 48 in a manner that one of its forks 72 its longest fork, is biased out of opening 56 in surface 16. A spring 74 attaches to hooks 62 and 66 and extends under axle 24 on the side opposite end 20. This biases one of the forks 76, its longest fork, of second furcated lever 52 through 58 in surface 18. The biasing action of the springs 68 and 74 is evident from viewing FIG. 4.

Figure 2:
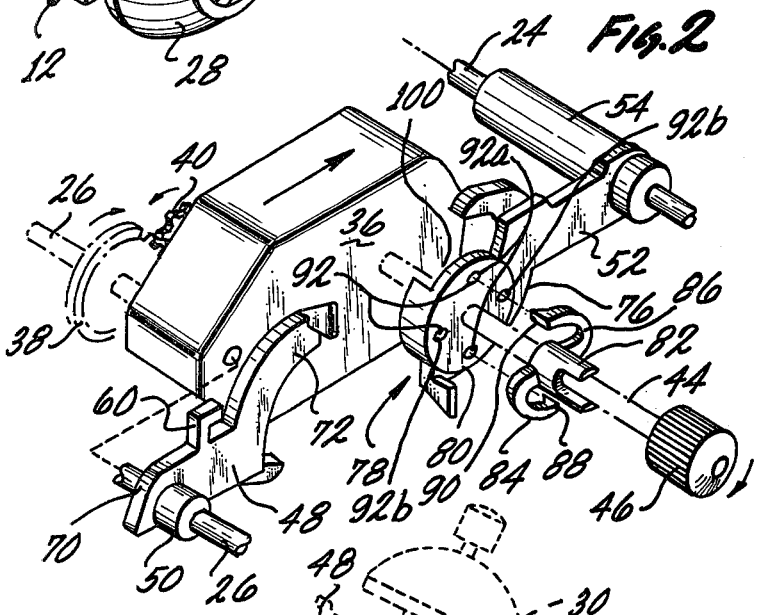
FIG. 2 is an exploded isometric view of certain of the internal working components of the toy.

The movement of the first and second furcated levers 48 and 52 are governed not only by springs 68 and 74, but also by a retaining member 78 which functions as follows. Retaining member 78 is composed of two pieces. The first of these is disk member 80 which is freewheeling about shaft 44. The other component of retaining member 78 is spring member 82 which is fixedly attached to shaft 44 and therefore rotates with respect to rotation of shaft 44. Spring member 82 has two spring arms 84 and 86. On the end of the respective spring arms 84 and 86 are detent teeth 88 and 90. Disk member 80 contains four holes collectively identified by the numeral 92 oriented ninety degrees apart from each other and spaced on the surface of slotted disk 80 such that the detent teeth 88 and 90 can fit into the pairs 92*a* and 92*b* of the opposing holes 92. This orientation is best seen in FIG. 2. The interaction of the detent teeth 88 and 90 with the holes 92 serves as a clutch mechanism to prevent damage to the toy during winding as hereinafter explained.

Disk member 80 contains an opening 100 in its wall 94 as viewable in FIG. 4. The opening 100 extends through approximately one hundred and thirty-five degrees of the wall 94. The other fork 96 of the first furcated lever 48 and the other fork 98 of second furcated lever 52 are positioned near the disk member 80. When the disk member 80 is oriented such that the wall 94 is adjacent to one of the forks 96 or 98, e.g. 98 in FIG. 4, the wall 94 contacts the fork 96 or 98 and presses against the fork 96 or 98 rotating the respective furcated lever 48 or 52 about the respective bearing 50 or 54 against the bias of the respective spring 70 or 74 retracting the respective forks 72 or 76 through the respective opening 56 or 58 in the respective surfaces 16 and 18 such that the respective furcated levers 48 or 52 are in the retracted position within the toy vehicle 10. When the opening 100 in the wall 92 of the disk member 80 is adjacent one of the respective forks 96 and 98 that fork fits into the opening 100 in the wall 94 and allows the respective furcated lever 48 or 52 to be extended under the bias of the respective spring 70 or 74 out of the opening 56 or 58 to an extended position. In FIG. 4 furcated lever 52 is in the retracted position and furcated lever 48 is in the extended position.

As shown in FIG. 4 the disk member 80 is rotated by the motor counterclockwise. In the position shown in FIG. 4 the wall 94 is just contacting the fork 96 and as the disk member 80 continues rotating counterclockwise the furcated lever 48 will be drawn in through the opening 56 against the bias of the spring 70. As the disk member 80 rotates from its position shown in FIG. 4 approximately ninety degrees counterclockwise the opening 100 approaches the fork 98. As soon as the edge 102 of the opening 100 clears the tip of fork 98, fork 98 will be forcibly drawn into the opening 100 by the bias of spring 74. This forcibly causes fork 76 to be expelled out of opening 48 from the retracted to the extended position. When the fork 76 contacts a support surface the momentum of its impact is transferred via furcated lever 52 to the toy vehicle 10, flipping or inverting the toy vehicle 10.

The bifurcated levers 48 and 52 are retracted back from the extended position to the retracted position by the interaction of edge 104 and wall 94 of slotted disk 80. In the position shown in FIG. 4 bifurcated lever 48 will be retracted into the toy 10 as the edge 104 presses against the fork 96 depressing the fork 96 in a direction away from hole 56 toward hole 58. Once the edge 104 has cleared the end of the fork 96, the end of the fork 96 becomes lodged against the wall 94 maintaining the bifurcated lever 48 in the retracted position. This retracting of the bifurcated levers 48 and 52 is against the bias of springs 70 and 74 and therefore these springs are tensed when the bifurcated levers 48 and 52 are in the retracted position.

The detent teeth 88 on spring member 82 are shaped such that counterclockwise rotation of the shaft 44, as best seen in FIG. 2, drives the detent teeth 88 and 90 into the holes 92. It will be remembered that the counterclockwise rotation of the shaft 44 occurs during the unwinding of the spring motor. When the spring motor is wound, however, shaft 44 turns clockwise. Should the operator of the toy pick up the toy in such a manner that the operator's fingers touch or interfere with one or both of the furcated levers 48 or 52, this would lock these levers in relationship to the disk member 80. The detent teeth 88 and 90 are shaped with oblique surfaces on one side such that clockwise rotation of shaft 44 allows these detent teeth to be lifted up out of the holes 92 and slip along the surface of disk member 80. The arms 84 and 86 were, as noted above, spring arms. This allows them to flex away from disk member 80 in response to movement of the detent teeth 88 and 90 out of the holes 92. The interaction of spring member 82 with disk member 80 thus provides a slipping or clutch action when the shaft 44 is rotated clockwise, but a positive locking action when the shaft 44 is rotated counterclockwise.

Figure 5:
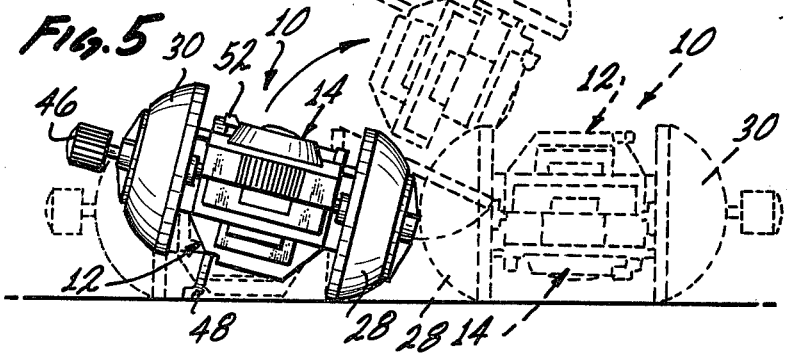
FIG. 5 is an end elevational view of the toy of FIG. 1 shown in a variety of orientations with respect to a support surface as illustrated in both solid and phantom lines.
Figure 3:
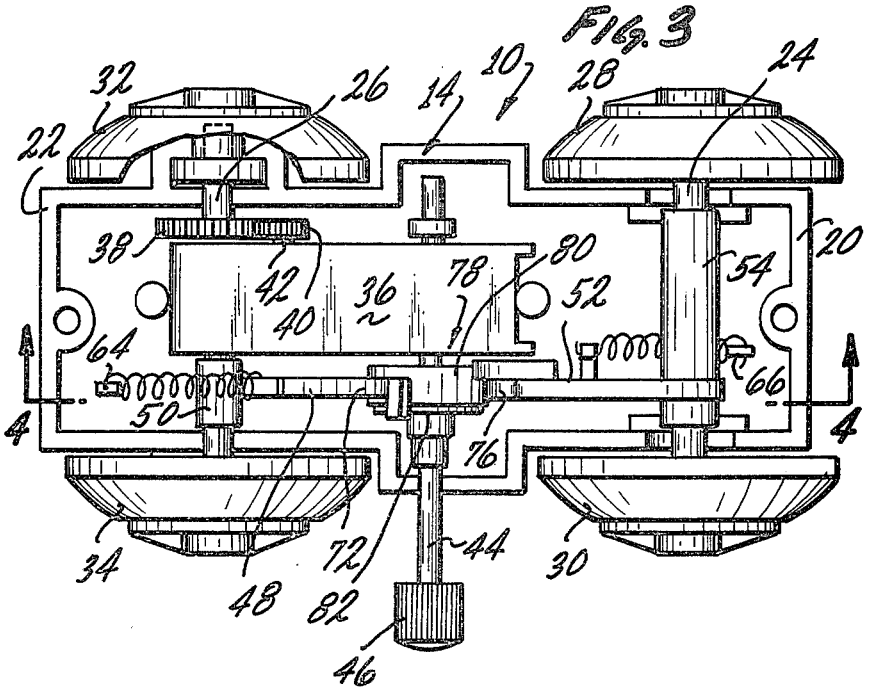
FIG. 3 is a plan view of a portion of the housing of the toy of FIG. 1 including those internal components shown in FIG. 2.

As is evident in the figures, the wheels 28, 30, 32 and 34 have a semispherical shape. Thus, these wheels not only provide rotation about the periphery about the circumference, but also can provide for rotation about the arc on their semispherical surface. When the toy is inverted or flipped, as is best seen in FIG. 5, the shape of the wheels 28, 30, 32 and 34 contribute to the inverting or flipping action. While the toy 10 can be completely lifted from its support surface by the forcible interaction of the furcated levers 48 and 52 with a support surface, the shape of the wheels 28, 30, 32 and 34 is such that, if for some reason the support surface is slippery or otherwise detracts from the momentum of the furcated levers 48 and 52, it is only necessary to invert the toy vehicle 10 for the momentum of these levers to be such that the toy vehicle 10 rolls over the apex of the wheels 28, 30, 32 and 34. In this rolling action the two wheels located on one side of the toy tend to act in tandem. The location of the furcated levers 48 and 52 on the side of the toy 10 wherein shaft 44 projects from the toy 10 also contributes to the toys ability to flip or be inverted. As seen in FIG. 5 in the solid figure, the furcated lever 48 which is exposed below the toy 10 and is contacting the support surface is located off center of the midline of the toy 10. This location, off center, contributes to a rolling action of the toy. In effect, the wheels (wheel 28 and wheel 32, which is hidden from view) in FIG. 5 which are still in contact with the support surface in the solid figure act as a fulcrum or pivot point for the toy 10, thus the momentum given to the toy 10 is to one side of this fulcrum or pivot point which causes the toy 10 to be inverted when it is flipped.

In using the toy the child winds the spring motor via knurled knob 46. The child then sets the toy on a support surface and releases it. The toy will propel itself forward for a period of time then invert itself until the surface 16 or 18 which was first the bottom of the toy is now the top of the toy. This inverting of the toy also causes it to change direction from the one it originally moved. After a second interval of time, the toy will once again invert itself and again change direction. This continues until the motor is wound down.

I claim:

1. A mechanism for lifting at least a portion of a toy off of a surface on which the toy rests, said toy of the type having an outside housing, which comprises:

a motor located in said toy housing and capable of producing a rotary output;

a rotary member located in said housing and operatively connected to said motor and rotating in response to said rotary output of said motor;

a curved wall formed on said rotary member, said curved wall having a convex surface and including an opening between the ends of said curved wall, said wall and said opening rotating as said rotary member rotates;

at least one furcated member movably mounted in said housing and positioned in said housing in a location allowing in a first instance a first portion of said furcated member to be extended away from said housing when a second portion of said furcated member is located within said opening between the ends of said wall and in a second instance said first portion of said furcated member to be retracted towards said housing when said second portion of said furcated member is located adjacent to said convex surface of said wall;

biasing means operatively associated with said furcated member biasing said furcated member to said position wherein said first portion of said furcated member is extended away from said housing, said second of said furcated member when located adjacent to said convex surface of said wall retaining said first portion of said furcated member towards said housing against the force of said biasing means and said second portion of said furcated member when located within said opening between the ends of said wall allowing said first portion of said furcated member to be extended away from said housing under the bias of said biasing means;

said first portion of said furcated member when extended away from said housing capable of lifting at least a portion of said toy off of said surface on which said toy rests.

2. The mechanism of claim 1 including:

two of said furcated members, each of said two furcated members capable of lifting a portion of said toy off of said surface on which said toy rests.

3. The mechanism of claim 2 wherein:

said two of said furcated members comprise a first and a second furcated member, the second portion of each of said first and said second furcated members being associated with said rotary member such that each of said second portion of said furcated member can be located adjacent to said convex surface or within said opening between the ends of said wall.

4. The mechanism of claim 3 including:

a clutch means, said clutch means operatively associated with and interspaced between said motor and said rotary member such that the rotary output of said motor is transferred to said rotary member by said clutch.

5. The mechanism of claim 4 wherein:

when the second portion of said first furcated member is located adjacent to said convex surface of said wall the second portion of said second furcated member is located within said opening between the ends of said wall.

6. The mechanism of claim 5 wherein:

said housing of said toy includes a first housing surface and a second housing surface spaced apart from each other and both of said first housing surface and said second housing surface reversibly capable of serving as a top for said housing or a bottom for said housing such that when said first housing surface serves as said top, said second housing surface serves as said bottom and when said second housing surface serves as said top, said first housing surface serves as said bottom.

7. The mechanism of claim 6 wherein:

said first portion of said first furcated member is associated with and is capable of extending away from and being retracted towards said first housing surface and said first portion of said second furcated member is associated with and is capable of extending away from and being retracted towards said second housing surface.

* * * * *